US006792999B2

(12) United States Patent
Cross et al.

(10) Patent No.: US 6,792,999 B2
(45) Date of Patent: Sep. 21, 2004

(54) TAB RELEASE CORD TENSION DEVICE

(75) Inventors: David Cross, Westport, CT (US); Richard Fraczek, Stamford, CT (US)

(73) Assignee: Rollease, Inc., Stamford, CT (US)

( * ) Notice: Subject to any disclaimer, the term of this patent is extended or adjusted under 35 U.S.C. 154(b) by 0 days.

(21) Appl. No.: 10/292,029

(22) Filed: Nov. 12, 2002

(65) Prior Publication Data

US 2003/0111188 A1 Jun. 19, 2003

Related U.S. Application Data

(60) Provisional application No. 60/347,973, filed on Nov. 13, 2001.

(51) Int. Cl.[7] ..... A47G 9/78

(52) U.S. Cl. ..... 160/321; 474/138

(58) Field of Search ..... 474/136, 138, 474/117, 114; 160/84.04, 321, 322, 315, 24, 344; 254/414; 185/44, 45; 267/174, 176, 72

(56) References Cited

U.S. PATENT DOCUMENTS

| | | | | |
|---|---|---|---|---|
| 3,123,351 | A * | 3/1964 | Graber | 267/71 |
| 4,846,766 | A * | 7/1989 | Glatzel | 474/138 |
| 5,752,558 | A * | 5/1998 | Lin | 160/320 |
| 5,845,696 | A * | 12/1998 | Chou | 160/178.1 V |
| 6,311,756 | B1 | 11/2001 | Anderson et al. | |
| 6,447,415 | B1 * | 9/2002 | Hashimoto et al. | 474/110 |

* cited by examiner

*Primary Examiner*—Blair M. Johnson
(74) *Attorney, Agent, or Firm*—Jeffrey M. Kaden; Gottlieb, Rackman & Reisman, P.C.

(57) ABSTRACT

A tensioning device for the cord loop of a window treatment apparatus includes a cord guide disposed in a housing, a biasing element such as a spring and a locking member that locks the cord guide into an installation position. During installation, the cord guide is fixed so that it cannot move and does not affect the tensioning of the cord. After installation, the locking member is removed and the cord guide can move in one direction or another to properly tension the cord.

13 Claims, 9 Drawing Sheets

TAB RELEASE CORD TENSION DEVICE

RELATED APPLICATIONS

This application claims priority to provisional application Ser. No. 60/347,973 filed Nov. 13, 2001 and incorporated herein by reference.

BACKGROUND OF THE INVENTION

A. Field of Invention

This application pertains to a device for tensioning the cord used for operating a roller blind or other similar window covering, and more particularly to a tensioning device that is adapted to adjust the tension automatically to adjust for changes in the physical characteristics of the cord.

B. Description of the Prior Art

Window coverings such as roller blinds, vertical and horizontal Venetian blinds, and so on, are typically operated by control cords that can be pulled in one direction or another. While many window coverings use a cord with two ends, systems are also popular that use a cord forming a closed loop. However, such systems are alleged ti be potentially dangerous to children. Therefore, interested organizations (such as the American National Standards Institute (ANSI) and the Window Covering Manufacturers Association (WCMA)) have developed a specification, in conjunction with the Consumer Products Safety Commission (CPSC), requiring such closed loop cord control systems to be secured by a tensioning device. The tensioning device is used externally of the window covering and is arranged so that it applies a tension in the cord within a predetermined range.

These tensioning devices are extremely effective in minimizing the danger to infants and young children resulting from the improper use of these cords. However, one problem with them is that during installation they must be carefully adjusted because if too much tension is applied, the window covering becomes difficult to operate and the additional stress on the window covering components results in a high wear and tear and reduced useful life. In fact, under certain conditions if the tension is high enough, the window covering may stop operating.

Strict instructions are normally provided to installers on how to install the window covering and the tensioning device. However, these instructions are frequently ignored, especially if the installer is the homeowner and not a professional.

A further problem in existing tensioning devices is that a high tension may develop after the tensioning device is installed due to changes in the physical characteristics of cord. For example, if the cord is made of knit or braided material, its fibers may shrink due to age, temperature and/or humidity changes, resulting in an increased tension.

OBJECTIVES AND SUMMARY OF THE INVENTION

In view of the disadvantages of the prior art, it is an objective of the present invention to provide a tensioning device that adjusts automatically to maintain tension in a continuous cord to a predetermined level.

A further objective is to provide a tensioning device that can be installed easily and quickly without requiring any special tools or techniques.

Yet another objective is to provide a tensioning device that does not require any extensive redesign, changes of components or other increased costs.

Other objectives and advantages of the invention shall become apparent from the following description.

Briefly, a tensioning device adapted to tension a cord loop of a window treatment apparatus includes a housing; a cord guide disposed in said housing and adapted to receive a portion of the cord loop; a biasing member adapted to bias said cord guide to apply tension on said cord loop; and locking means adapted to lock said cord guide in an installation position, said locking means being removable to allow said cord guide to tension said cord loop. The locking means includes a tab removably inserted into said cord guide. The tab may be a flexible tab extending through said housing and said cord guide. In one embodiment, rails defining a path of movement for said cord guide are disposed within said housing, the cord guide being adapted to shift up and down in the housing along the guide to selectively increase or decrease the tension on the cord loop.

In another embodiment, the cord guide includes a pulley rotatably disposed in said housing.

In another aspect of the invention, the tensioning device includes a housing having two housing portions; a cord guide movably disposed within said housing and adapted to receive a cord loop; a biasing spring coupled to said cord guide and adapted to apply a biasing force on said cord guide to thereby tension said cord loop; and a locking tab extending through said housing, said locking tab being constructed and arranged to lock said cord guide against movement during installation, said locking tab being removable to release said biasing spring.

DETAILED DESCRIPTION OF THE INVENTION

Figure 1:
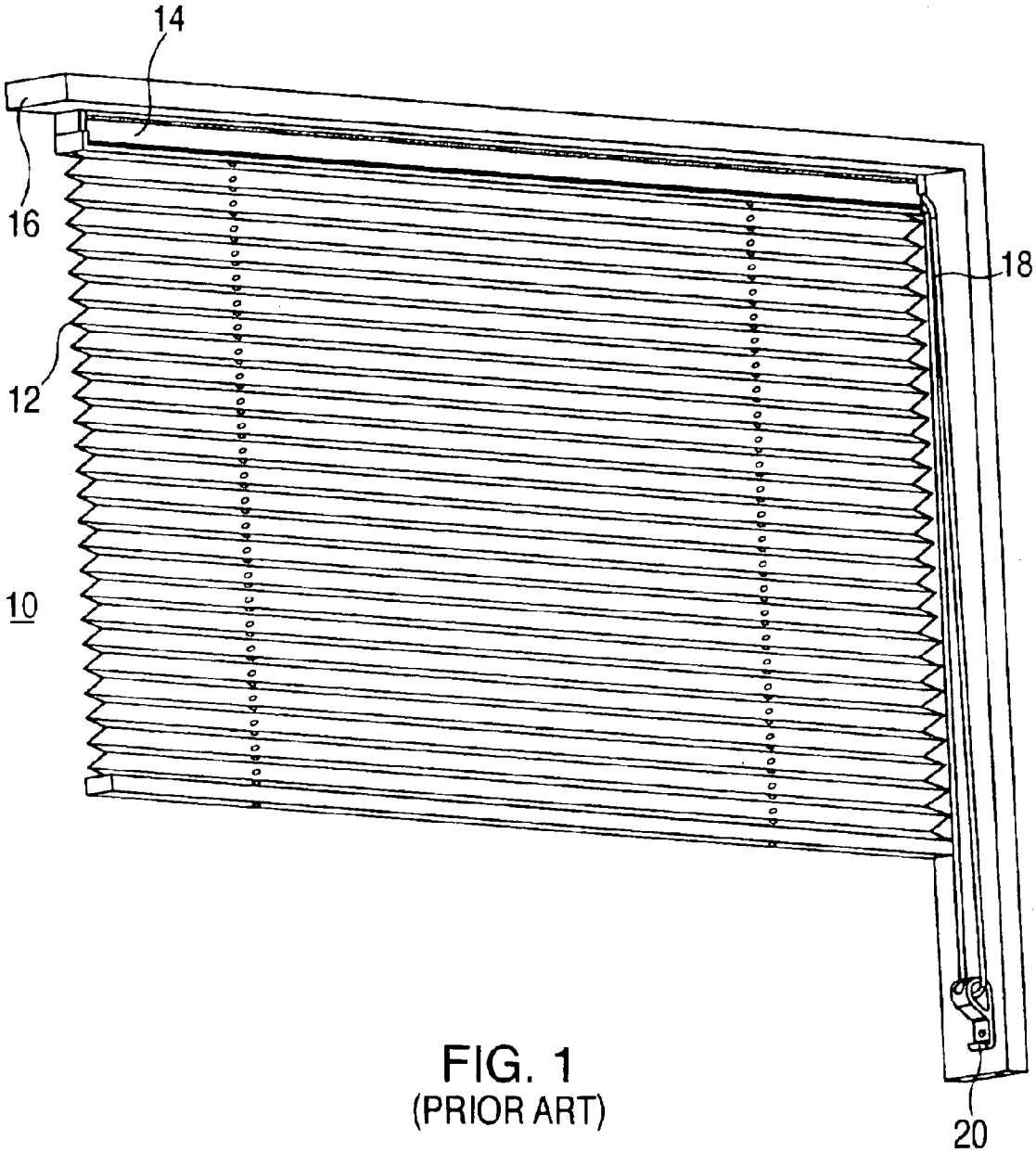
FIG. 1 (PRIOR ART)
FIG. 1 shows a perspective view of a window covering with a first prior art tensioning device.
Figure 2A:
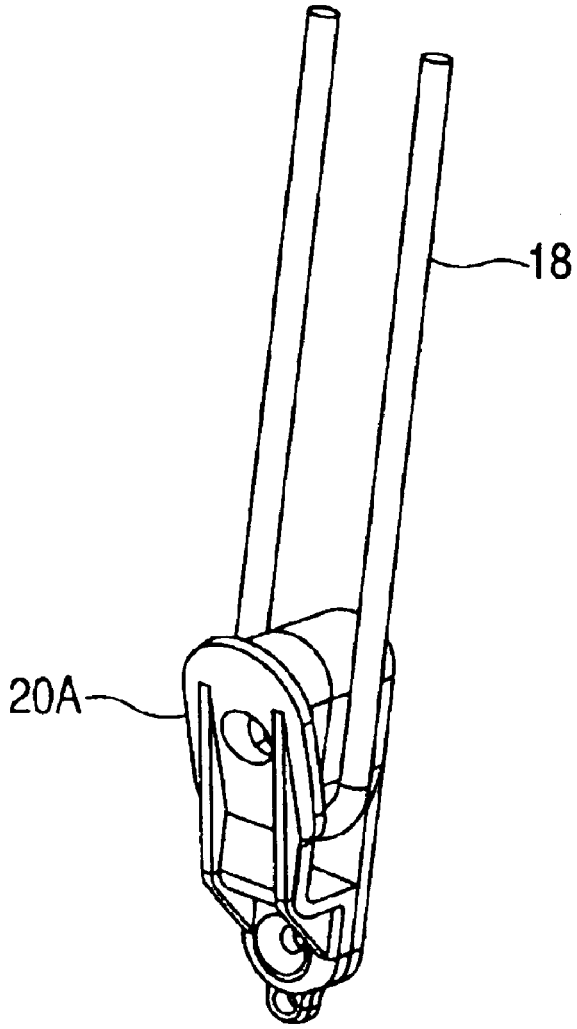
FIGS. 2*a* and 2*b* show perspective views of other prior art tensioning devices without springs.
Figure 2B:
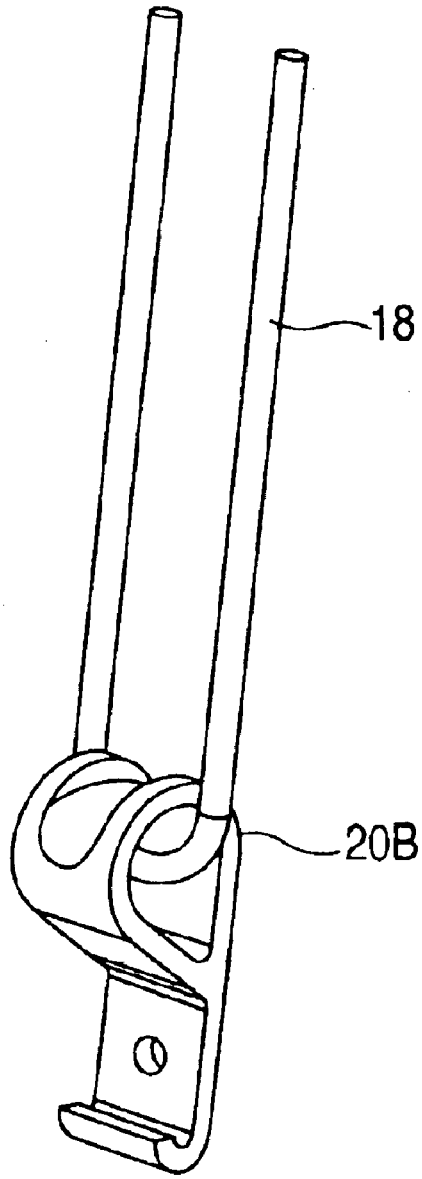

FIG. 1 shows a typical installation of a window treatment apparatus with tensioning means. The window treatment apparatus 10 consists in this case of a folded panel 12 hanging from a cassette 14. The cassette 14 is secured to a window frame 16. Incorporated within the cassette 14 there is a mechanism (not shown) which is not part of this invention and which is activated or operated by a cord loop 18. The cord loop passes through a tension device 20 also secured to the window frame 16 and is adapted to provide tension in cord loop 18. FIGS. 2A and 2B show two types of tension devices 20A and 20B which do not utilize springs or any other active means of generating tension in the loop cord 18. Hence, the tension in the loop cord 18 is controlled only by the position of the tension devices on the frame 16. If this position is not selected properly, or if the loop cord 18 shrinks over time, the tension within the loop will increase, possibly to a level that may render the apparatus 10 inoperable.

Figure 3C:
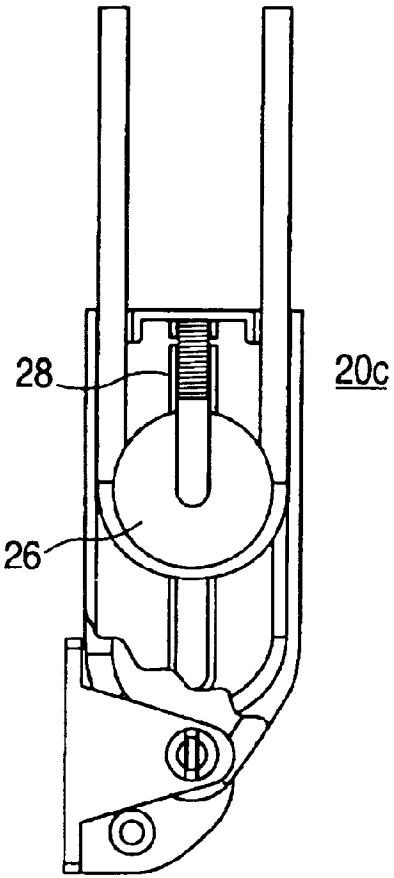
FIG. 3C (PRIOR ART)
FIGS. 3A–3C show a side elevational view of a prior art tensioning device with a spring and a pulley in an unmounted position, a mounted and operational position and a mounted and inoperational position, respectively.
Figure 3B:
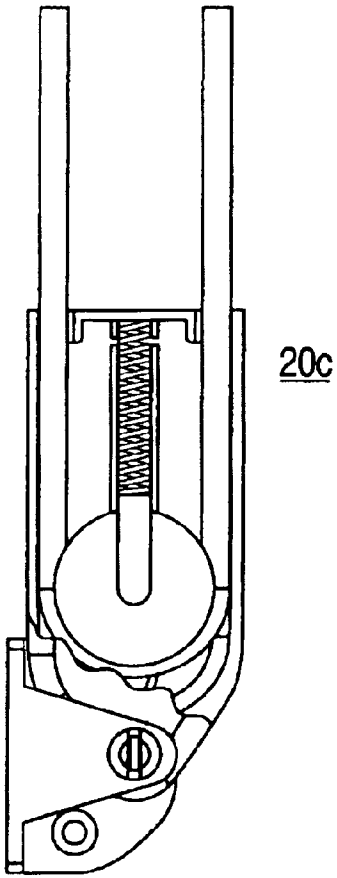
FIG. 3B (PRIOR ART)
Figure 3A:
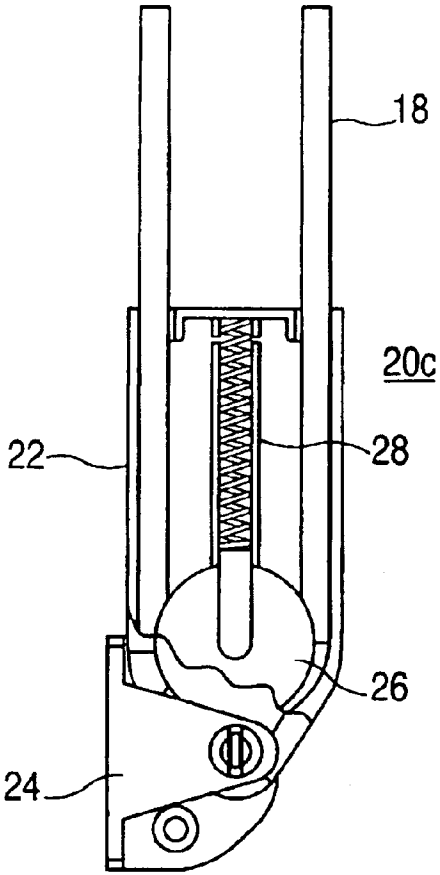
FIG. 3A (PRIOR ART)

FIGS. 3A–3C show a more advanced tensioning device 20C for tensioning cord loop 18. The device 20C includes a housing 22 supported by a bracket 24. Inside the housing there is provided a pulley 26 biased in the downward direction by a spring 28. The cord loop 18 is trained around the pulley, as shown. FIG. 3A shows the tension device 20C before installation, with the spring 28 being relaxed. FIG. 3B shows the device 20C installed. Normally, the device 20C is positioned so that the pulley 26 is raised slightly and pushes upwardly against the spring 28. In this position, the tension in cord loop 18 is dependent on the force generated by the spring 28. However, if the device 20C is installed too low and/or if the cord loop 18 shrinks excessively, the pulley 26 is raised sufficiently to squeeze the spring 28 tightly up against the top 30 of housing 22. Under these conditions, the spring 28 is in effect disabled and the tension within the cord loop 18 may be high enough to interfere with the operation of, or even disable the respective apparatus. A tensioning device of this type is disclosed in U.S. Pat. No. 6,311,756, incorporated herein by reference.

A tensioning apparatus constructed in accordance with the present invention is shown in FIGS. 4–8. In this embodiment, the apparatus 120 includes a housing 122 formed of two housing parts 122A, 122B. A through hole 123 passes through the housing parts 122A, 122B. A bracket 24 is constructed and arranged to be mounted on a window frame. A straight pin 25 is used to attach housing 122 to the bracket 24 by passing the pin 25 through holes 123 and 125 in bracket 24.

Within the housing 122 there is provided a cord guide 126. Guide 126 is substantially semicircular with an annular groove 127 for accommodating the cord loop 18. The cord guide 126 is associated with a spring 128. More particularly, groove 129 are provided to allow the cord guide 126 to move up and down within the housing 122. A spring 128 is disposed between the cord guide 126 and a top 130 portion of housing 122. As in the embodiment of FIGS. 3A–3C, the cord guide is biased downwardly by the spring 128. Preferably, housing part 122A is formed with tracks 131. The cord guide 126 is constructed so that it can move up and down on the tracks 131 within the housing 122.

Figure 4:
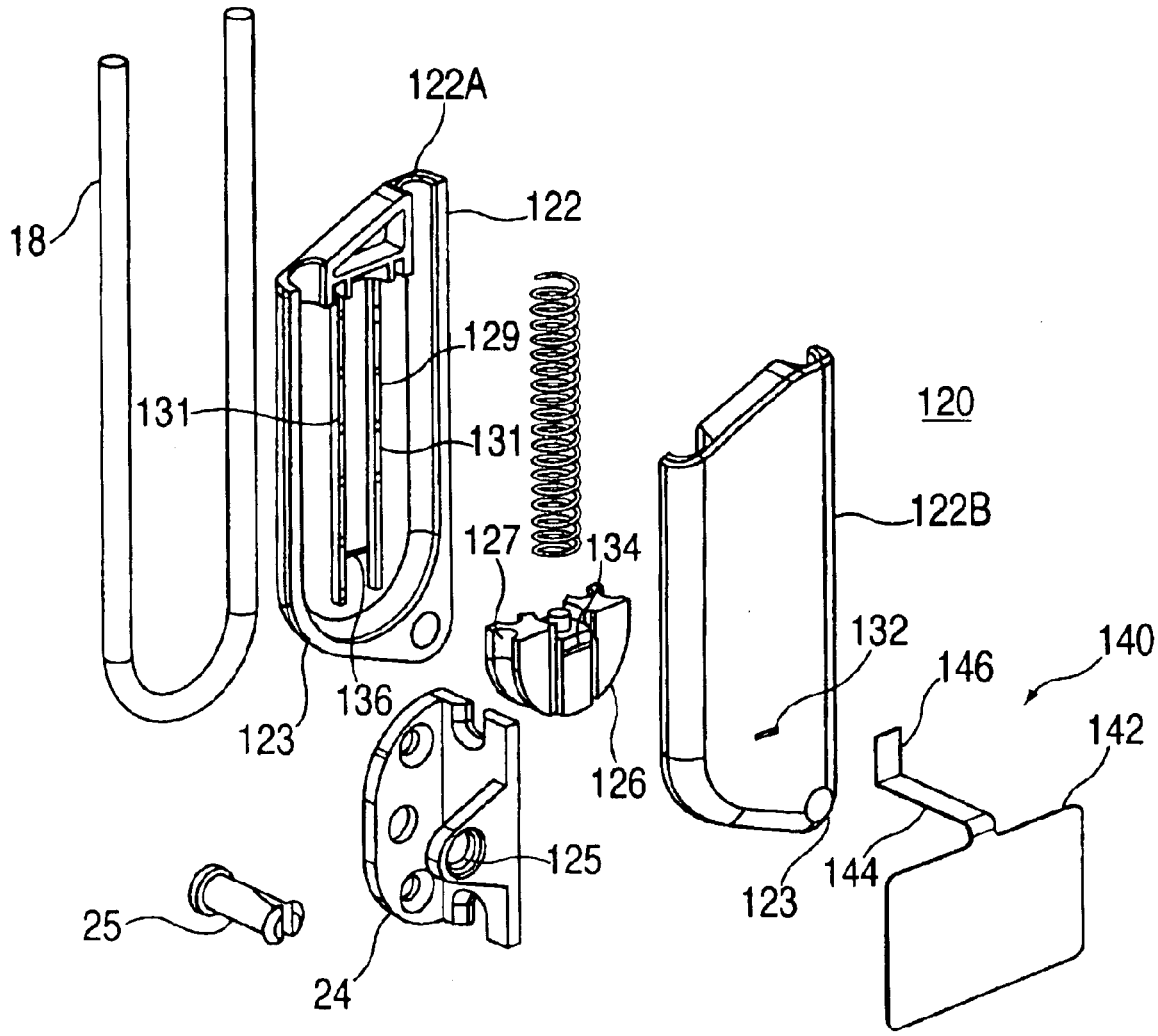
FIG. 4 shows an exploded view of a tensioning device constructed in accordance with this invention.

Importantly, the housing part 122B is formed with a horizontal slot 132. A similar slot 134 is provided in the cord guide 126 and a third slot 136 is formed in the housing part 122A as shown. The cord guide 126 can be positioned between the housing portions 122A, 122B so that the three slots 132, 134, 136 are aligned to receive and accommodate a tab 140. As seen in FIG. 4, the tab 140 is formed of a front portion 142 which is relatively flat and an intermediate portion 144 and a rear portion 146. The front and rear portions 142, 146 are substantially parallel and the intermediate portion 144 is perpendicular to the end portion and is sized and shaped to fit through slots 132, 134, 136. The front portion 142 is large enough so that it can be imprinted with some instructions.

Figure 5:
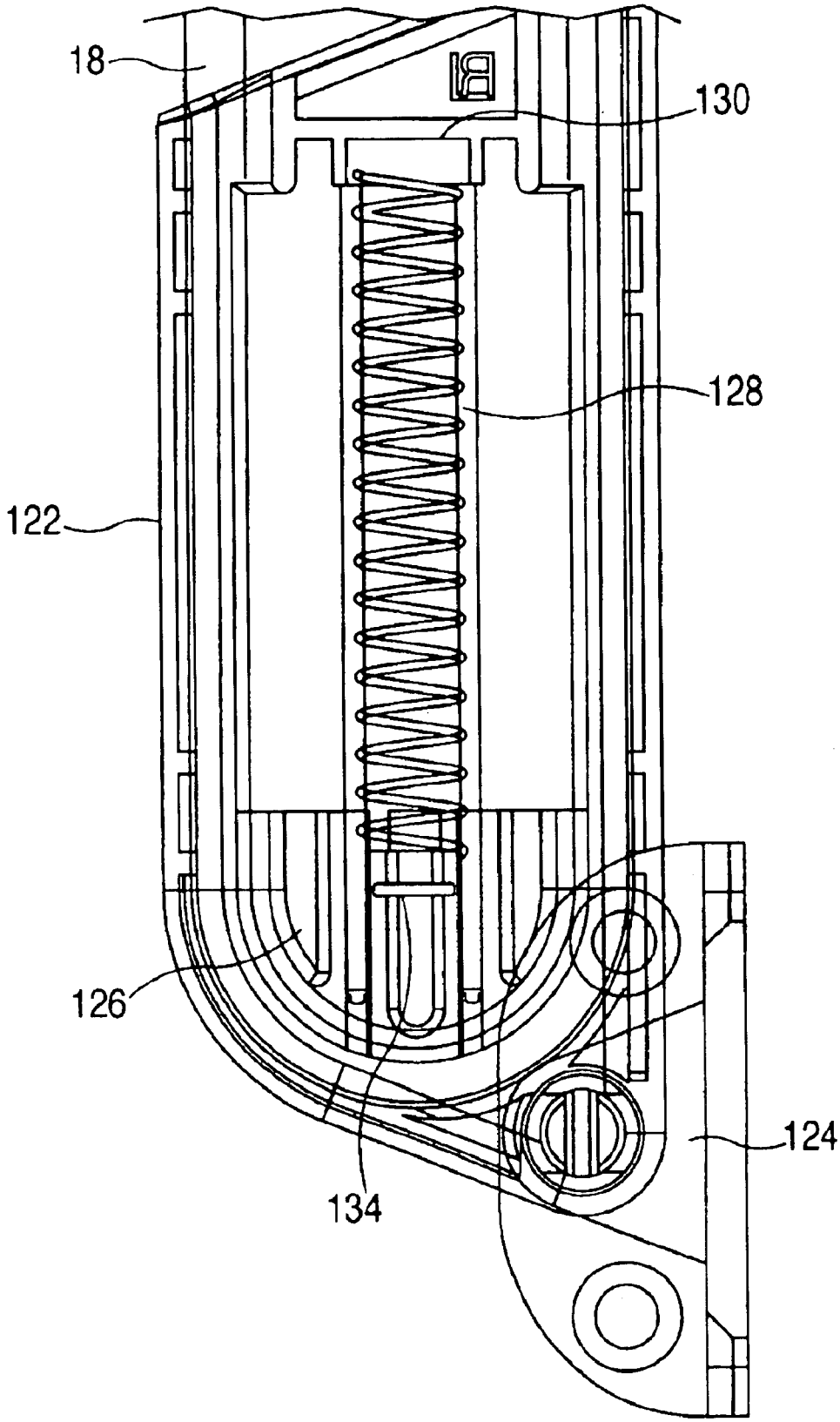
FIG. 5 shows a side elevational cross sectional view of a tensioning device constructed in accordance with this invention.
Figure 6:
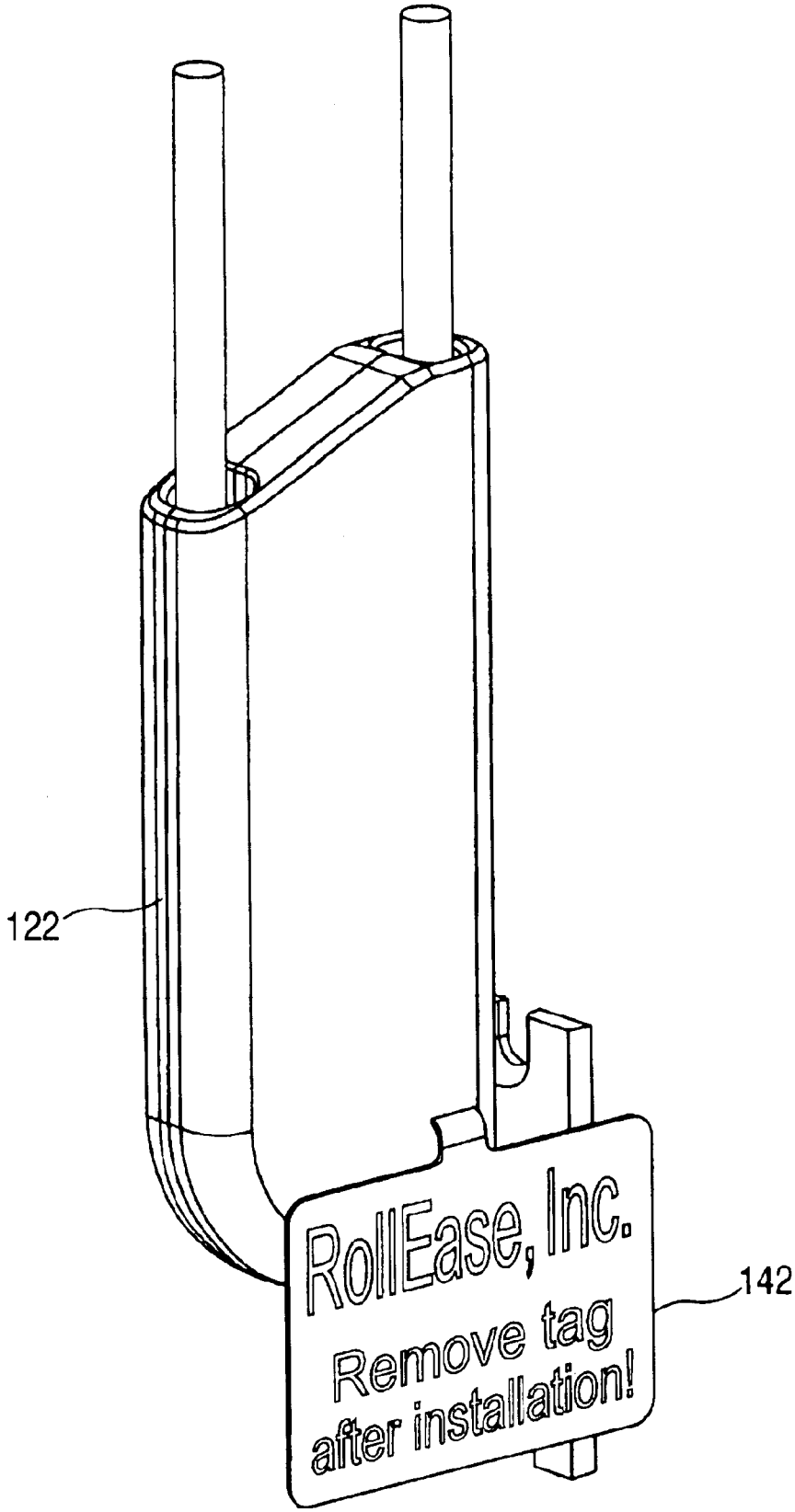
FIG. 6 shows a front perspective elevational view of a tensioning device constructed in accordance with this invention with the housing closed.
Figure 7:
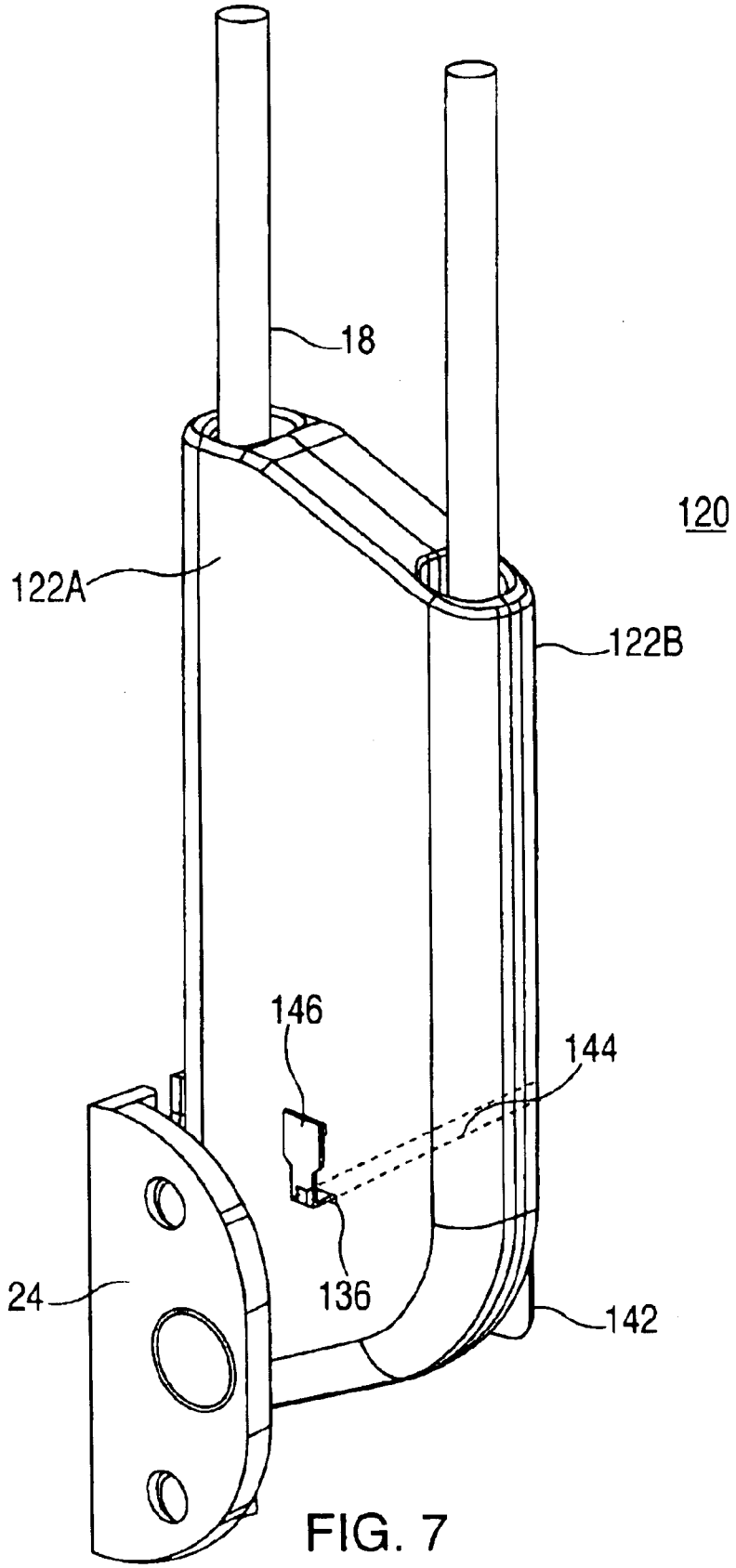
FIG. 7 shows a rear perspective elevational view of a tensioning device constructed in accordance with this invention, with the housing closed.

When the tensioning device 120 is completely assembled, the front and rear portions 142, 146 of tab 140 are abutting the housing portions 122B,122A, respectively, with the intermediate portion 144 extending through the housing portions 122B, 122A and the cord guide 126, as seen in FIGS. 7 and 8. As shown in FIG. 5, in this position the cord guide 126 is pushing upwardly against the spring 128 so that the spring is somewhat compressed. Thus, tab 140 defines an installation position for the cord guide 126 in which the guide can travel a large distance vertically upward before coil 128 is completely compressed.

Figure 8C:
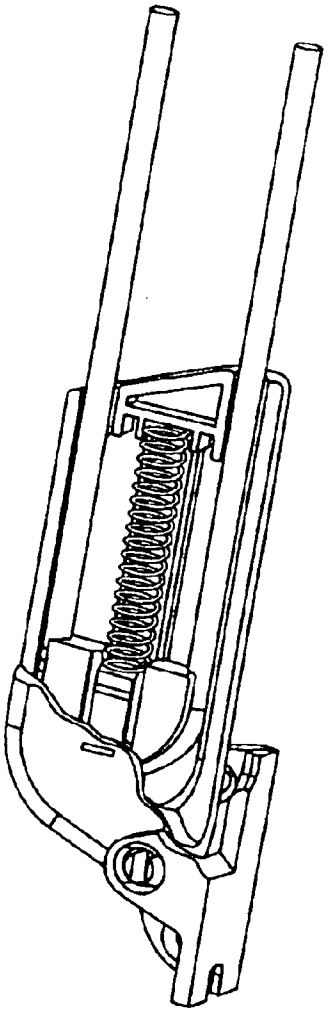
FIGS. 8A–8C show a side elevational view of a tensioning device without a pulley constructed in accordance with the present invention in a mounted, a mounted intermediate, and a mounted final position, respectively.
Figure 8B:
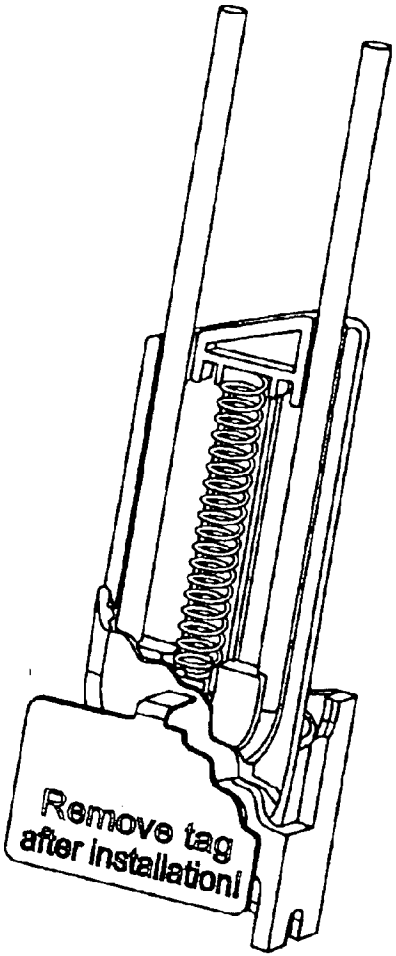
Figure 8A:
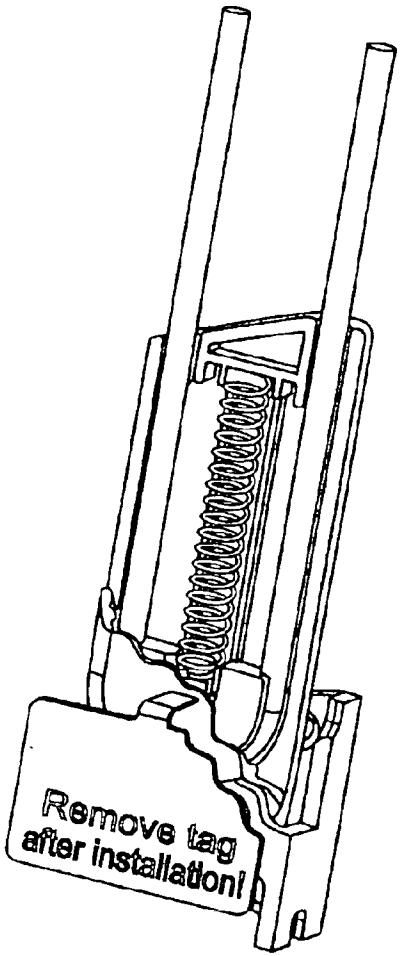

The tensioning device 120 is shipped with the tab 140 in place and the cord guide 126 locked in the installation position, as defined above, and shown in FIG. 8A. When the tensioning device 120 is received, it is first installed on its bracket 24 while the tab 140 is in place, as shown in FIG. 8B. The installer is instructed to insure that the bracket should be positioned to insure that the cord loop 18 is relatively taught, not loose. Because the tab 140 prevents movement of the cord guide 126, the spring 128 does not yet apply any force on the cord loop 18.

The tab 140 is made of an elastic material so that as the front portion 142 is pulled forward, the rear portion 144 is bent and can be retrieved through the slots 132, 134, 136. The tab 140 can be made of paper or plastic. Once the tensioning device 120 is properly installed, the tab 140 is removed, as shown in FIG. 8C. As soon as the tab is removed, the cord guide 126 is pushed down by the spring 128 thereby tensioning the cord loop 18 to the proper level. Moreover, if the cord loop 18 gets shorter because of shrinkage or other reason, the cord guide 126 automatically rises to compensate for this effect. However, because in its initial or installation position, the cord guide 126 is positioned at the bottom of the housing 120, there is sufficient room in the housing to allow the cord guide 126 to rise applying excessive tension on the cord loop 18 and disabling the whole apparatus.

Figure 9:
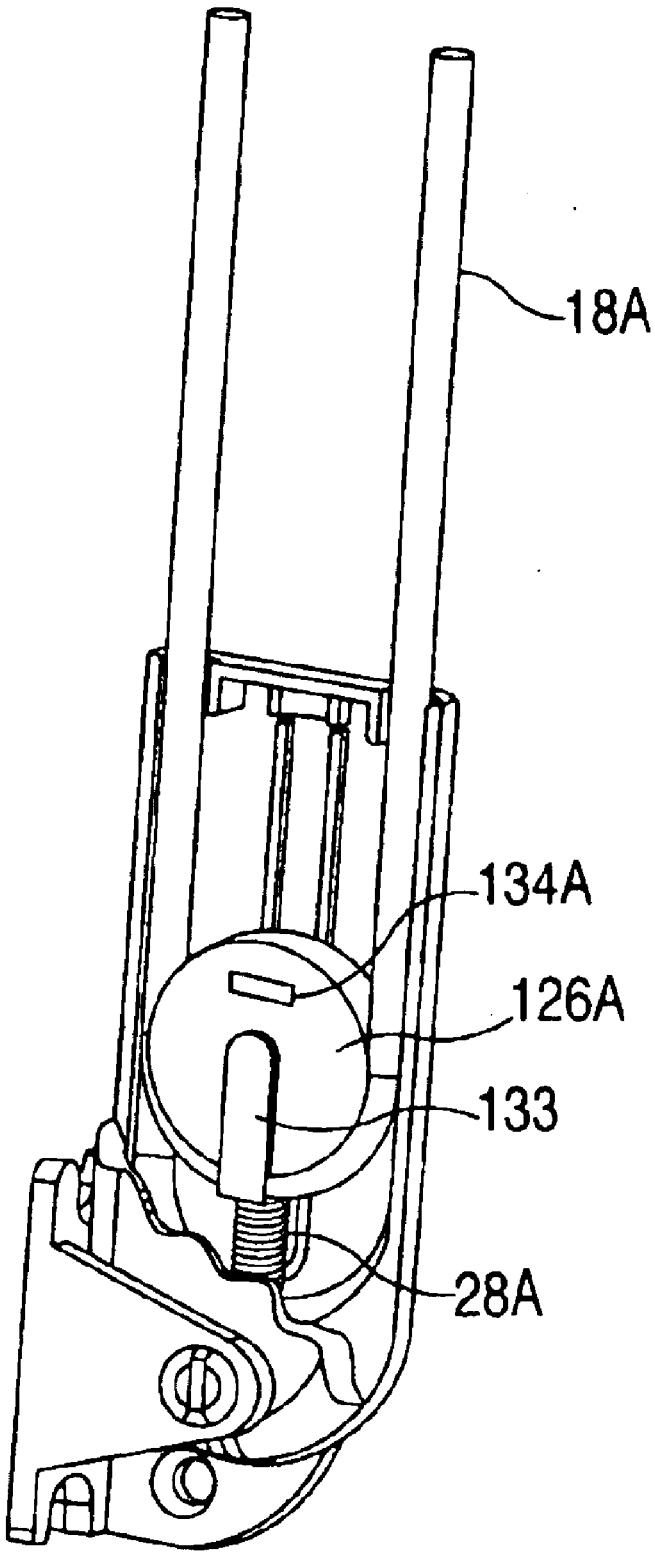
FIG. 9 shows a perspective view of an alternate embodiment of the invention with a pulley.

In the embodiment of FIGS. 4–8, the cord guide 126 provides groove 127 through which the cord loop 18 can slip. In order to reduce friction, the cord guide 126 can incorporate a pulley 126A, as shown in FIG. 9. The pulley 126A is formed with a slot 134A to accommodate a tab as described above. In addition, as shown in FIG. 9, instead of a compression-type spring 18, a tension spring 28A can be used to bias the pulley 126 downwardly. Of course, a similar tension spring 28A may also be used for the embodiments of FIGS. 4–8.

The pulley 126A is rotatably supported by a bracket 133 which is then connected to the end of spring 128A. The slot 134A may be provided in the bracket 133 rather than the pulley 126A.

The tensioning device described herein is advantageous because it insures that the cord loop is properly tensioned at installation. Moreover, if the tension on the cord loop changes, for example, due to changes in the physical characteristics of the cord loop, the device automatically adjusts itself by allowing the cord guide or pulley to shift.

The tab can also be made of a relatively stiff material, in which case it is inserted into the housing through the slots and can be selectively removed therefrom without necessary bending any of its portions.

While the invention has been described with reference to several particular embodiments, it is to be understood that these embodiments are merely illustrative of the principles of the invention. Accordingly, the embodiments described in particular should be considered as exemplary, not limiting, with respect to the following claims.

We claim:

1. A tensioning device adapted to tension a cord loop of a window treatment apparatus, said tensioning device comprising:

a housing receiving a portion of said cord loop;

a cord guide disposed in said housing and adapted to receive said portion of cord loop;

a biasing member adapted to bias said cord guide to apply tension on said cord loop; and a locking member removably inserted through said housing and said cord guide adapted to lock said cord guide in an installation position within said housing, said locking member being removable from said housing to allow said cord guide to tension said cord loop.

2. The tensioning device of claim 1 wherein said locking member includes a tab removably inserted into said cord guide.

3. The tensioning device of claim 1 wherein said locking member includes a flexible tab extending through said housing and said cord guide.

4. The tensioning device of claim 1 further comprising rails defining a path of movement for said cord guide within said housing.

5. The tensioning device of claim 1 wherein said cord guide includes a pulley rotatably disposed in said housing.

6. A tensioning device comprising:

a housing having two housing portions;

a cord guide movably disposed within said housing and adapted to receive a cord loop;

a biasing spring coupled to said cord guide and adapted to apply a biasing force on said cord guide to thereby tension said cord loop; and a locking tab extending through said housing portions and said cord guide, said locking tab being constructed and arranged to lock said cord guide against movement during installation, said locking tab being removable to release said biasing spring.

7. The tensioning device of claim 6 wherein said cord guide is slidably disposed in said housing.

8. The tensioning device of claim 6 wherein said cord guide includes a pulley rotatably disposed in said housing, said pulley being disabled by said tab.

9. The tensioning device of claim 6 wherein said housing includes a slot, and said locking tab extends into said housing through said slot.

10. The tensioning device of claim 9 wherein said cord guide includes another slot receiving said locking tab.

11. A method of tensioning the cord of a window treatment apparatus comprising:

providing a tensioning device including a housing with a cord guide adapted to receive the cord a spring adapted to bias said cord guide to tension said cord and a locking member extending through said housing and said cord guide to lock said cord guide in an installation position;

installing said tensioning device; and removing said locking member to allow said cord guide and said spring to tension said cord.

12. The method of claim 11 wherein said cord guide is allowed to change position after said locking member is removed to tension said cord.

13. A tensioning device adapted to tension a cord loop of a window treatment apparatus, said tensioning device comprising:

a housing;

a cord guide disposed in said housing and adapted to receive a portion of said cord loop;

a biasing means adapted to bias said cord guide to apply tension on said cord loop; and locking means adapted to lock said cord guide in an installation position, said locking means being removable to allow said cord guide to tension said cord loop, wherein said locking means includes a flexible tab extending through said housing and said cord guide.

* * * * *